United States Patent [19]

Bell, Jr.

[11] Patent Number: 4,569,511

[45] Date of Patent: Feb. 11, 1986

[54] VISE PADS

[76] Inventor: Sammy S. Bell, Jr., 11215 N. 52nd Ave., Glendale, Ariz. 85304

[21] Appl. No.: 774,386

[22] Filed: Sep. 9, 1985

Related U.S. Application Data

[63] Continuation of Ser. No. 540,165, Oct. 7, 1983, abandoned.

[51] Int. Cl.[4] ..... B25B 1/24

[52] U.S. Cl. ..... 269/276

[58] Field of Search ..... 269/274–277, 269/271

[56] References Cited

U.S. PATENT DOCUMENTS

| | | | |
|---|---|---|---|
| 1,653,326 | 12/1927 | Welter | 269/271 |
| 2,519,107 | 8/1950 | Brown | 269/275 |
| 2,766,649 | 10/1956 | Labry | 269/274 |
| 3,065,960 | 11/1962 | Miller | 269/276 |
| 3,215,010 | 11/1965 | Montgomery et al. | 269/274 |
| 3,322,423 | 5/1967 | Popow et al. | 269/275 |

FOREIGN PATENT DOCUMENTS

| | | | |
|---|---|---|---|
| 1313223 | 4/1973 | United Kingdom | 269/276 |

*Primary Examiner*—Robert C. Watson

*Attorney, Agent, or Firm*—Harry M. Weiss & Associates

[57] ABSTRACT

Vise jaw pads are disclosed which cushion the jaws of a vise and protect the surface of a workpiece gripped in the vise. Each of the pads is formed from a piece of flexible material such as flexible PVC, has an L-shaped cross section, and a length about equal to the width of the vise jaw. The pads each have magnets attached to the back, concave surface to secure the pads to the vise jaw. The front, convex surface of the pads is adapted to increase the gripping ability of the pads with respect to a workpiece held in the vise.

1 Claim, 4 Drawing Figures

VISE PADS

This application is a continuation of application Ser. No. 540,165 filed Oct. 7, 1983 now abandoned.

BACKGROUND OF THE INVENTION

This invention relates generally to vise jaw pads, and more specifically to flexible pads attachable to the jaws of a vise.

The jaws of a vise are usually made of hardened steel or similar material. The hard material allows a workpiece to be securely held in the vise when the jaws are tightened down on the workpiece, but the hard material can easily damage the workpiece being held. The vise jaws may crush the workpiece or leave an imprint of the jaw on the workpiece.

Those using a vise for holding a workpiece have attempted to overcome the foregoing problem, for example, by forming a soft metal sleeve to slip over the vise jaws. A soft metal sleeve, such as a sleeve formed of copper, is an improvement over hardened steel, but still damages the workpiece surface. The copper becomes dented and irregular and leaves an imprint of this irregular surface on the workpiece. Attempts have also been made to cushion the workpiece with strips of wood placed between the workpiece and the jaw surface. The pieces of wood are difficult to work with, as they are difficult to position and to maintain in position while the vise is being tightened on the workpiece.

Accordingly, a need existed for cushioned pads to be used with vise jaws to overcome the above-related problems.

It is therefore an object of this invention to provide an improved pad for a vise jaw.

It is another object of this invention to provide an improved vise jaw pad which can be secured to a vise jaw.

It is still another object of this invention to provide an improved vise jaw pad having enhanced gripping ability.

BRIEF SUMMARY OF THE INVENTION

The foregoing and other objects and advantages of the invention are achieved with a flexible view jaw pad. The pad has a length at least equal to about the width of the vise jaw and an L-shaped cross section. The back or concave surface of the pad is provided with magnetic means to secure the pad to the vise jaw. The front or convex surface of the pad is formed to enhance to gripping ability of that surface.

DETAILED DESCRIPTION OF THE PREFERRED EMBODIMENT

Figure 1:
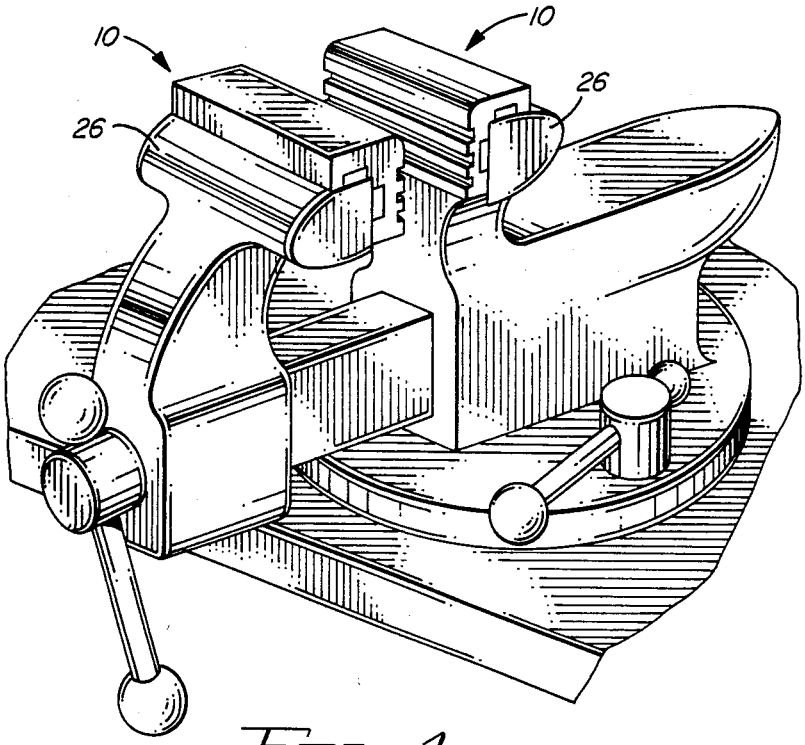
FIG. 1 illustrates, in perspective view, a vise jaw pad attached to a vise jaw.
Figure 2:
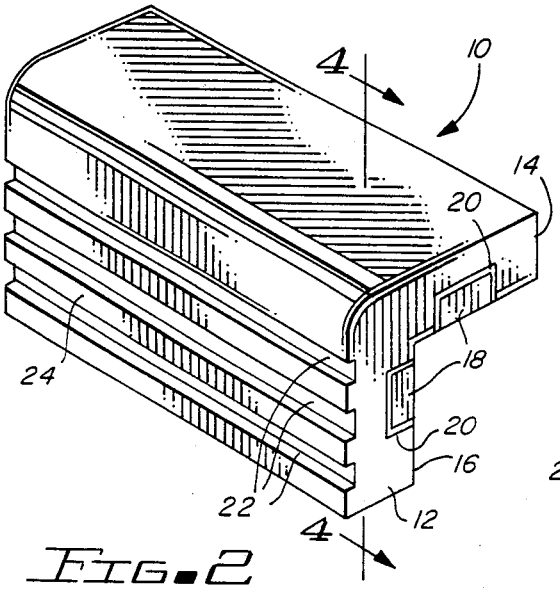
FIG. 2 illustrates the vise jaw pad, in perspective view, showing grooves and convex surfaces which form a gripping surface.
Figure 3:
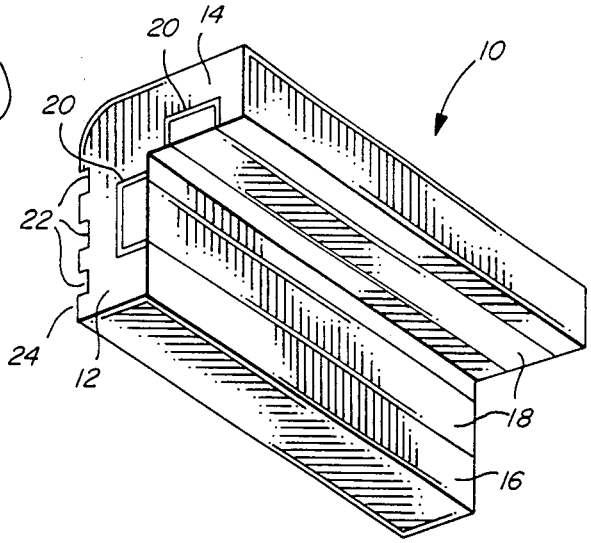
FIG. 3 illustrated the vise jaws pad, in perspective view, showing magnetic strips which attach the vise jaw pad to the vise jaw.

FIG. 1 illustrates a vise jaw pad 10 in accordance with the invention. The pad has a length, x, which is about equal to the width of the vise jaw to which it is to be attached. Although the pad can be longer or shorter than the width of the vise jaw, a shorter pad decreases the effective gripping area of the vise and a longer pad is relatively ineffective and has reduced gripping ability at the extremities extending beyond the vise jaw. The pad has a generally L-shaped cross section, here shown to be an inverted L-shape. One leg 12 of the L-shaped cross section has a greater thickness than the other leg 14.

Pad 10 is formed from a piece of strong, flexible material such as flexible plastic material. Preferably pad 10 is formed of a flexible material such as flexible polyvinyl chloride (PVC). The flexible material must be strong and resilient to allow effective gripping of a workpiece. The material must also be deformable to prevent damage to the surface of the workpiece. Pad 10 can be molded, extruded, machined, or otherwise formed from the flexible material.

Magnetic means are attached to the back or concave surface 16 of the pad to secure the pad to the view jaw. Preferably the magnetic means comprises flexible magnetic strips 18 which are positioned in grooves 20 formed in concave surface 16. Preferably, at least one strip magnet is attached to each of the legs 12, 14. The outer surface of strip magnet 18 is flush with pad surface 16. Magnets 18 are glued or otherwise cemented into grooves 20.

To enhance the gripping ability of the vise jaw pads and thus of the vise utilizing the pads, grooves 22 or other shapes are formed on the front or convex surface 24. Preferably surface 24 is provided with a plurality of shallow grooves formed parallel to the length of pad 10. In alternate embodiments (not shown) surface 24 can be knurled, hatched, or the like.

Figure 4:
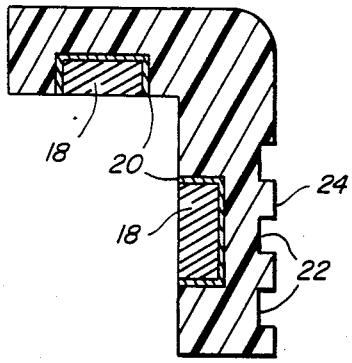
FIG. 4 is a cross-sectional view of the vise jaw pad taken in the direction of arrows 4—4 shown in FIG. 2.

FIG. 4 illustrates, in cross section, one embodiment of vise jaw pad 10. Magnetic strips 18 attached to the concave surface of pad 10 secure the pad to the vise jaw. The thicker leg 12 of pad 10 is positioned against the vertical face of jaw 26. The other, thinner leg 14 is positioned against the horizontal upper face of jaw 26. Grooves 22 enhance the gripping ability of pad 10 while the pad provides a protective cushion between the workpiece to be held and the hardened metal of jaw 26.

In a preferred embodiment, pad 10 is formed of flexible PVC and has a length equal to the width of the vise jaw to which it is to be attached. Preferable dimensions are as follows. Leg 12 has length of about 0.75–1.0 inch and a thickness of about 0.3–0.4 inches. Leg 14 has a length of about 0.75–1.0 inch and a thickness of about 0.15–0.25 inch. Strip magnets 18 are about 0.06 inches thick and about 0.34 inches wide and are flexible, such as those available from the 3M company. Grooves 22 are about 0.06 inches in depth and width.

Thus it is apparent that there has been provided, in accordance with the invention, a vise jaw pad which fully meets the objects and advantages set forth above. While the invention has been described and illustrated by reference to specific embodiments thereof, it is not intended that the invention be limited to those embodiments. Those skilled in the art will understand that changes in form and detail may be made without departing from the spirit and scope of the invention.

I claim:

1. Pads for covering the jaws of a vise and for protecting a workpiece held in said vise, each of said pads comprising:

an elongated piece of flexible polyvinyl chloride plastic having a cross section comprising an L-shape, said elongated piece having two legs, one leg being adjacent to the vertical face of one said jaws and the other being adjacent to the top surface of said one of said jaw, said one leg covering the entire width of a substantial portion of said one of said jaws, said other leg also covering the entire width of a portion of the top surface of said one of said jaws;

magnetic flexible strip magnets cemented into grooves in the inside surfaces of said legs extending at least substantially along the length of said elongate piece for securing said pad to said one of said jaws, said magnetic flexible strip magnets extending the width of both the vertical face of said one jaw and the top surface of said one jaw, the thickness of said one of said two legs being about twice that of said other of said two legs yet each of said leg permits the accommodation of at least one of said strip magnets thereto, each of said strip magnets has an external surface flush with each of said inside surfaces of said legs substantially along the length of each of said legs; and a plurality of elongated groove means parallel to said elongate direction attached to the outside surface of said one leg for providing a plurality of generally flat gripping outside surfaces located along the length of said elongate piece for increasing the grip and cushioning effects of said pad on said workpiece.

* * * * *